US010636366B2

(12) United States Patent
Kang et al.

(10) Patent No.: US 10,636,366 B2
(45) Date of Patent: Apr. 28, 2020

(54) DISPLAY DEVICE OPERATING IN IMPULSE MODE AND IMAGE DISPLAY METHOD THEREFOR

(71) Applicant: SAMSUNG ELECTRONICS CO., LTD., Suwon-si (KR)

(72) Inventors: Jin-sung Kang, Hwaseong-si (KR); Sung-hwan Jang, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/754,170

(22) PCT Filed: Aug. 3, 2016

(86) PCT No.: PCT/KR2016/008547
§ 371 (c)(1),
(2) Date: Feb. 21, 2018

(87) PCT Pub. No.: WO2017/052066
PCT Pub. Date: Mar. 30, 2017

(65) Prior Publication Data

US 2018/0247600 A1 Aug. 30, 2018

(30) Foreign Application Priority Data

Sep. 22, 2015 (KR) ..... 10-2015-0133779

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/3648* (2013.01);
(Continued)

(58) Field of Classification Search
CPC ..... G09G 3/3406; G09G 2320/0247; G09G 2320/0646; G09G 2360/16;
(Continued)

(56) References Cited

U.S. PATENT DOCUMENTS 8,395,365 B2 3/2013 Latham et al.
8,866,463 B2 10/2014 Latham, II et al.
(Continued)

FOREIGN PATENT DOCUMENTS

KR 10-2007-0060299 A 6/2007
KR 10-2008-0000508 A 1/2008
(Continued)

OTHER PUBLICATIONS

International Search Report (PCT/ISA/210) dated Dec. 13, 2016 issued by the International Searching Authority in counterpart International Application No. PCT/KR2016/008547.

*Primary Examiner* — Xuemei Zheng
(74) *Attorney, Agent, or Firm* — Sughrue Mion, PLLC

(57) ABSTRACT

Disclosed is a display device including: a display panel configured to display an image of a series of frames based on input image data; a light source configured to emit light to the display panel; a light source driver configured to supply a driving signal to the light source so that the light source can emit light; and a processor configured to detect a brightness change of a first frame of image data input to the display panel, make the light source driver supply a driving signal having a first frequency to the light source when the brightness change is lower than a predetermined boundary value, and make the light source driver supply a driving signal having a second frequency lower than the first frequency to the light source when the brightness change is higher than the boundary value. Thus, it is possible to decrease a flicker that occurs when the liquid crystal display
(Continued)

device is driven with a PWM signal, i.e. an impulse signal for reducing a motion blur.

17 Claims, 13 Drawing Sheets

(52) U.S. Cl.
CPC ..... *G09G 2320/0247* (2013.01); *G09G 2320/0261* (2013.01); *G09G 2320/064* (2013.01); *G09G 2320/0646* (2013.01); *G09G 2320/0686* (2013.01); *G09G 2320/103* (2013.01); *G09G 2320/106* (2013.01); *G09G 2340/0435* (2013.01); *G09G 2340/16* (2013.01); *G09G 2360/16* (2013.01)

(58) Field of Classification Search
CPC ..... G09G 2320/0261; G09G 2320/064; G09G 2320/103
See application file for complete search history.

(56) References Cited

U.S. PATENT DOCUMENTS

| | | | | |
|---|---|---|---|---|
| 2003/0142118 | A1* | 7/2003 | Funamoto ..... | G09G 3/3406 345/691 |
| 2006/0170822 | A1* | 8/2006 | Baba ..... | G09G 3/3406 348/500 |
| 2009/0027025 | A1 | 1/2009 | Latham et al. | |
| 2009/0244112 | A1* | 10/2009 | Jung ..... | G09G 3/3406 345/691 |
| 2014/0035542 | A1 | 2/2014 | Latham, II et al. | |

FOREIGN PATENT DOCUMENTS

| | | | | |
|---|---|---|---|---|
| KR | 10-2008-0048655 | A | | 6/2008 |
| KR | 10-2012-0063757 | A | | 6/2012 |
| KR | 10-2014-0077452 | A | | 6/2014 |
| KR | 20140077452 | A | * | 6/2014 |

* cited by examiner

FIG. 4

(nFRAME BRIGHTNESS:0~255)

| | | | |
|---|---|---|---|
| b1(123) | b2(116) | b3(125) | b4(170) |
| b5(136) | b6(115) | b7(101) | b8(212) |
| b9(055) | b10(168) | b11(183) | b12(200) |
| b13(222) | b14(76) | b15(100) | b16(77) |

(n-1FRAME BRIGHTNESS:0~255)

| | | | |
|---|---|---|---|
| b1(123) | b2(115) | b3(120) | b4(170) |
| b5(136) | b6(111) | b7(096) | b8(212) |
| b9(055) | b10(168) | b11(183) | b12(200) |
| b13(222) | b14(76) | b15(100) | b16(77) |

DISPLAY DEVICE OPERATING IN IMPULSE MODE AND IMAGE DISPLAY METHOD THEREFOR

TECHNICAL FIELD

The present invention relates to a display device operating in an impulse mode and an image display method of the same.

BACKGROUND ART

In an active-matrix type display device, e.g. a liquid crystal display device, thin film transistors are arranged as switching elements at pixels, and a tilt angle of liquid crystal is changed to transmit or block light, thereby displaying an image. When the liquid crystal display device displays a moving image, the characteristics of the liquid crystal make a user perceive that an image blurs without clear contrast. Such difference in perception is caused by afterimage effects of an image temporarily sustained in eyes of tracking a motion. Therefore, a user sees a blurred image because of a mismatch between movement of eyes and a static image of every frame even though the liquid crystal display device has a high response speed. To avoid such a motion blur in the liquid crystal display device, there has been used a method of driving the liquid crystal display device with a pulse width modulation (PWM) signal, i.e. an impulse signal by adding black data on to a screen after displaying video data on the screen. In this case, the PWM signal for reducing the motion blur has a frequency of 60 Hz and is applied by lowering a duty ratio up to about 25% so that the PWM signal can be delayed in time to fully open the liquid crystal.

However, flickering, i.e. a screen flicker occurs due to an impulse applied when the liquid crystal display device is driven with the PWM signal of 60 Hz.

DISCLOSURE

Technical Problem

Accordingly, an aspect of the present invention is to provide a display device capable of decreasing a flicker and a motion blur, and an image display method of the same.

Technical Solution

In accordance with an exemplary embodiment, there is provided a display device including: a display panel configured to display an image of a series of frames based on input image data; a light source configured to emit light to the display panel; a light source driver configured to supply a driving signal to the light source so that the light source can emit light; and a processor configured to detect a brightness change of a first frame of image data input to the display panel, make the light source driver supply a driving signal having a first frequency to the light source when the brightness change is lower than a predetermined boundary value, and make the light source driver supply a driving signal having a second frequency lower than the first frequency to the light source when the brightness change is higher than the boundary value.

The brightness change may be detected based on comparison between each brightness of the first frame and a previously displayed second frame.

Each of the first frame and the second frame may include a plurality of pixel block areas, and the brightness change may be detected based on comparison between each brightness of the plurality of pixel block areas in the second frame and each corresponding brightness of the plurality of pixel block areas in the first frame.

The brightness change may be detected by calculating a difference in between brightness of the first frame and brightness of a second frame, determining that the brightness changes is not present when the calculated difference is within a predetermined boundary value, and determining that the brightness change is present when the calculated difference exceeds a predetermined boundary value.

Each of the first frame and the second frame may include a plurality of pixel blocks, and the calculated difference may be based on comparison between each brightness of the plurality of pixel block areas in the second frame and each corresponding brightness of the plurality of pixel block areas in the first frame.

The brightness change may be detected based on comparison between brightness of the first frame and average brightness of a plurality of second frames.

The first frequency may be 120 Hz, and the second frequency may be 60 Hz.

The predetermined boundary value may be divided into a first boundary value and a second boundary value higher than the first boundary value, and the processor may make the light source driver supply a driving signal having a third frequency higher than the first frequency when the brightness change of the first frame is lower than the first boundary value, and make the light source driver supply the driving signal having the first frequency when the brightness change is higher than the first boundary value and lower than the second boundary value.

The third frequency may be 240 Hz.

The predetermined boundary value may be lower than 10%.

The first boundary value may be equal to or lower than 5%, and the second boundary value may be higher than 5% and lower than 10%.

The processor may detect a motion variance in the first frame, make the light source driver supply the driving signal having the first frequency when the motion variance is not present, and make the light source driver supply the driving signal having the second frequency when the motion variance is present.

The first frame may be displayed as divided into an image display section and a non-display section when the motion variance is present.

The motion variance may be detected by obtaining a motion vector from change in between an object in the first frame and an object in a previously displayed second frame.

Each of the first frame and the second frame may include a plurality of pixel blocks, and the motion vector may be obtained from change in between an object in each of the plurality of pixel block areas of the second frame and a corresponding object in each of the plurality of pixel block areas of the first frame.

It may be determined that the motion variance is not present when the motion vector is within a predetermined threshold value, and it may be determined that the motion variance is present when the motion vector is beyond the predetermined threshold value.

The motion variance may be detected by obtaining a motion vector from change in between an object in the first frame and an object in the plurality of second frames.

The predetermined threshold value may be divided into a first threshold value and a second threshold value higher than the first threshold value, and the processor may make the light source supply a driving signal having a third frequency higher than the first frequency when the motion variance of the first frame is within the first threshold value, and make the light source driver supply the driving signal having the first frequency when the motion variance is within the second threshold value.

According to an aspect of another exemplary embodiment, there is provided an image display method of a display device including a display panel, a light source configured to emit light to the display panel, and a light source driver configured to supply a driving signal to the light source, the method including: detecting a brightness change of a first frame of image data input to the display panel; and making the light source driver supply a driving signal having a first frequency to the light source when the brightness change is lower than a predetermined boundary value, and making the light source driver supply a driving signal having a second frequency lower than the first frequency to the light source when the brightness change is higher than the boundary value.

Advantageous Effects

It is possible to decrease a flicker that occurs when the liquid crystal display device is driven with a PWM signal, i.e. an impulse signal for reducing a motion blur.

DESCRIPTION OF DRAWINGS

FIGS. 4 to 6 are views of illustrating brightness distribution with regard to a plurality of pixel block areas of a frame.

BEST MODE

Figure 1:
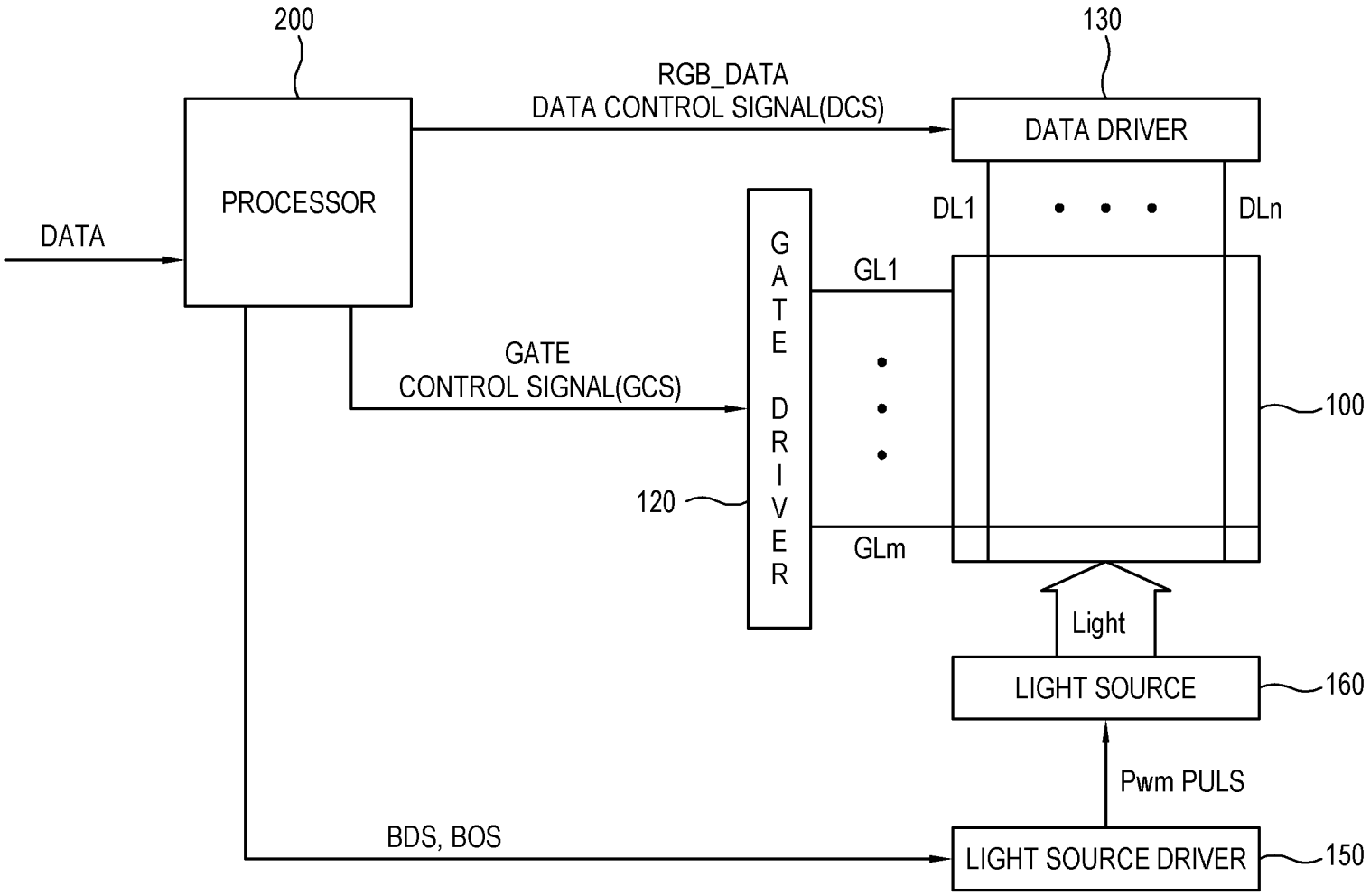
FIG. 1 is a block diagram of a liquid crystal display device according to one embodiment of the present invention.

Below, embodiments of the present invention will be described with reference to accompanying drawings. The following embodiments have to be considered as illustrative only, and it should be construed that all suitable modification, equivalents and/or alternatives fall within the scope of the invention. Throughout the drawings, like numerals refer to like elements.

In this specification, "have," "may have," "include," "may include" or the like expression refer to presence of the corresponding features (e.g.: numerical values, functions, operations, or elements of parts, and does not exclude additional features.

In this specification, "A or B," "at least one of A or/and B," "one or more of A or/and B" or the like expression may involve any possible combination of listed elements. For example, "A or B," "at least one of A and B," or "at least one A or B" may refer all of (1) at least one A, (2) at least one B, or (3) both at least one A and at least one B.

In this specification, "a first," "a second," "the first," "the second" or the like expression may modify various elements regardless of order and/or importance, and does not limit the elements. These expressions may be used to distinguish one element from another element. For example, a first user device and a second user device are irrelevant to order or importance, and may be used to express different user devices. For example, a first element may be named a second element and vice versa without departing from the scope of the invention.

If a certain element (e.g. the first element) is "operatively or communicatively coupled with/to" or "connected to" a different element (e.g. second element), it will be understood that the certain element is directly coupled to the different element or coupled to the different element via another element (e.g. third element). On the other hand, if a certain element (e.g. the first element) is "directly coupled to" or "directly connected to" the different element (e. g. the second element), it will be understood that another element (e.g. the third element) is not interposed between the certain element and the different element.

In this specification, the expression of "configured to" may be for example replaced by "suitable for," "having the capacity to," "designed to," "adapted to," "made to," or "capable of" in accordance with circumstances. The expression of "configured to" may not necessarily refer to only "specifically designed to" in terms of hardware. Instead, the "device configured to" may refer to "capable of" together with other devices or parts in a certain circumstance. For example, the phrase of "the processor configured to perform A, B, and C" may refer to a dedicated processor (e.g. an embedded processor) for performing the corresponding operations, or a generic-purpose processor (e.g. a central processing unit (CPU) or an application processor) for performing the corresponding operations by executing one or more software programs stored in a memory device.

In this specification, terms may be used just for explaining a certain embodiment and not intended to limit the scope of other embodiments. A singular expression may involve a plural expression as long as it does not clearly give different meaning contextually. All the terms set forth herein, including technical or scientific terms, have the same meanings as those generally understood by a person having an ordinary skill in the art. Terms defined in a general-purpose dictionary may be construed to have the same or similar meanings as the contextual meanings of the related art, and should not be interpreted as ideally or excessively formal meanings. As necessary, even the terms defined in this specification may be not construed to exclude the embodiments of the present invention.

The display device includes a liquid crystal display device, an electroluminescence display device, a light emitting diode (LED) display, a plasma display panel (PDP) device, etc., and the liquid crystal display device 1 will be described by way of example in the following embodiments.

As shown in FIG. 1, the liquid crystal display device 1 includes a display panel 100 for displaying an image signal, panel drivers 120 and 130 for driving the display panel 100, a light source 160 for emitting light to the display panel 100, a light source driver 150 for controlling the brightness of the light source 160 in response to a PWM signal, and a processor 200 for transmitting a data signal and a control signal to the panel drivers 120 and 130 and the light source driver 150 so as to display the image signal on the display panel 100. In addition to the foregoing elements, the liquid crystal display device 1 may further include many other elements such as a power supply (not shown), an image processor (not shown), a decoder (not shown), a graphic processor (not shown), a tuner (not shown), a communicator (not shown), etc. and detailed descriptions thereof will be omitted.

The display panel 100 includes a plurality of gate lines GL1 to GLm and a plurality of data lines DL1 to DLn, which intersect with one another, thin film transistors (not shown) formed at points where they intersect, and liquid crystal capacitors (not shown) connected to the thin film transistors. Although it is not illustrated, the thin film transistors include gate electrodes branched from the plurality of gate lines GL1 to GLm, semiconductor layers disposed on the gate electrodes with an insulation layer therebetween, source electrodes branched from the plurality of data lines DL1 to DLn, and drain electrodes opposite to the source electrodes. Such the thin film transistors control the liquid crystal capacitors.

The panel drivers 120 and 130 include a gate driver 120 and a data driver 130.

The gate driver 120 sequentially supplies scan signals to the plurality of gate lines GL1 to GLm in response to a gate control signal (GCS) generated in the processor 200. By the scan signals, the thin film transistors connected to the plurality of gate lines GL1 to GLm are turned on. The data driver 130 supplies data signals to the plurality of data lines DL1 to DLn in response to a data control signal (DCS) generated in the processor 200.

The processor 200 receives a horizontal sync signal H_sync, a vertical sync signal V_sync for determining a frame frequency of the display panel 100, image data DATA, main clock CLK, and a reference clock CLK. The processor 200 converts the image data DATA in accordance with formats required in the data driver 130, and supplies pixel data RGB_DATA to the data driver 130. The processor 200 provides the gate control signal GCS for controlling the gate driver 120 and the data control signal DCS for controlling the data driver 130 to the gate driver 120 and the data driver 130, respectively. Further, the processor 200 modulates the horizontal sync signal H_sync and the vertical sync signal V_sync based on the reference clock, and provides a dimming signal BDS and a light source driving signal BOS to the light source driver 150 based on the horizontal sync signal H_sync and the vertical sync signal V_sync.

The light source 160 is integrally attached to the display panel 100 as a light emitting diode (LED), a fluorescence lamp or the like backlight unit, and emits light to the display panel 100 based on supplied power. The light source 150 includes a plurality of lamps (not shown), brightness of which is controlled in response to the PWM signal.

The light source driver 150 applies a PWM signal in an impulse form to the light source 160 in accordance with a brightness control command of the processor 200. The light source driver 150 generates the PWM signal having a predetermined frequency based on the dimming signal BDS supplied from the processor 200, and supplies the PWM signal to the light source 160.

Figure 2:
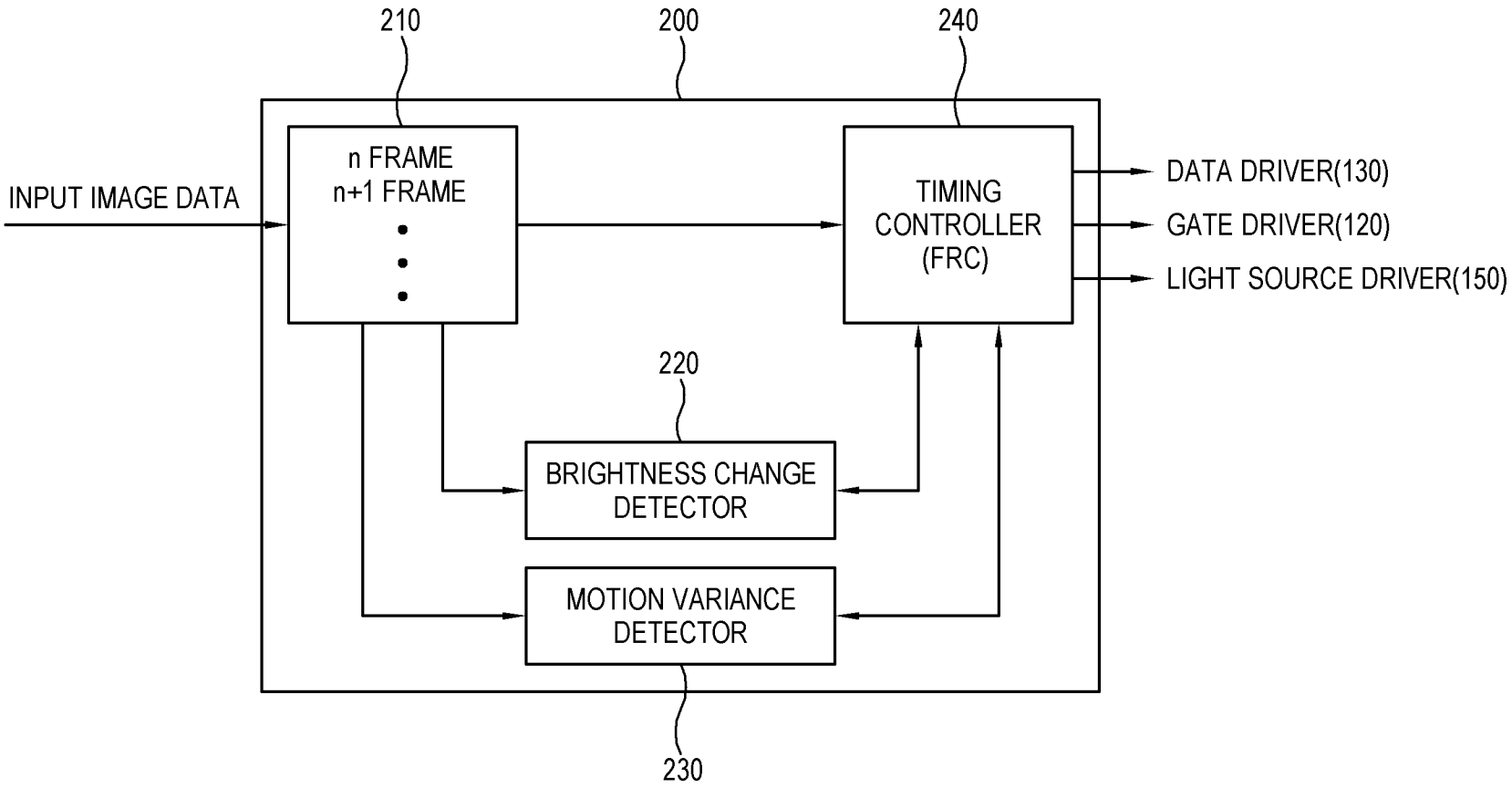
FIG. 2 is a block diagram of a processor according to one embodiment of the present invention.

Below, the processor 200 will be described in detail with reference to FIG. 2. FIG. 2 is a block diagram of the processor 200 shown in FIG. 1.

The processor 200 includes a storage 210 configured to store image data in units of a frame, a frame brightness change detector 220 configured to detect brightness change in the frame, a frame motion variance detector 230 configured to detect motion variance of a frame, and a timing controller 240.

The storage 210 serves as a frame memory to store the processed and input image data in units of the frame (e.g. the nth frame, the (n+1)th frame . . . ) in order of being displayed. The storage 210 may be for example materialized by a nonvolatile flash memory such as an electrically erasable programmable read-only memory (EEPROM).

The frame brightness change detector 220 may be for example materialized by software based on an algorithm for calculating and comparing average brightness levels, and/or embedded hardware in which brightness variance detection algorithm is designed as hardware. The frame brightness change detector 220 detects brightness variance of a frame to be currently displayed on the display panel 100 among the frames stored in the storage 210 or the frames of the input image data. The brightness change of the frame is determined by extracting an average pixel level as a feature amount of each frame, and comparing the average pixel level of the frame to be currently displayed with the average pixel level of a previous frame. The average pixel level refers to a brightness level to be represented in each pixel of the display panel, e.g. an average brightness value of all pixels represented with grayscale values of 0~255 in case of 256 grayscales. The detection of the frame brightness change is performed by comparison between the average pixel level of the current frame n and the average pixel level of the previous frame n−1. The detection of the frame brightness change may be performed by comparison between the average pixel level of the current frame n and the average pixel level of the plurality of previous frames, e.g. five frames n−1 to n−5. The detection of the frame brightness change may be performed by comparison between the average pixel level of the plurality of current frames, e.g. five frames n to n+4 and the average pixel level of the plurality of previous frames, e.g. five frames n−1 to n−5. Of course, the plurality of frames is not limited to five frames, and may be set properly. The detection of the frame brightness change may be performed by dividing one frame into a plurality of pixel blocks, e.g. sixteen pixel blocks, calculating the average pixel level of each pixel block, and comparing the corresponding pixel blocks. In this case, the average pixel levels of the pixel blocks are averaged to calculate the average pixel level of the frame. When a degree of brightness change is very low, there are no advantages in determining that the brightness is changed. Therefore, it is determined that the brightness is not changed when the brightness of the current frame is changed within a set boundary value (i.e. a change range), and it is determined that the brightness is changed only when the brightness is changed beyond the set boundary value. For example, the brightness change rate Bv (%) is defined by the following Expression [1].

$$Bv(\%)=(|b2-b1|)\div b2\times 100 \quad \text{[Expression 1]}$$

For example, under a condition that the brightness change rate Bv (%) is set to have a boundary value of $0\leq Bv\leq 10\%$ or $0\leq Bv\leq 5\%$, it is determined that the current frame has no brightness change when the brightness change rate is within this boundary value, and it is determined that the current frame has a brightness change only when the brightness change rate is beyond the boundary value. However, the boundary value of the brightness change rate Bv (%) is not limited to $0\leq Bv\leq 10\%$ or $0\leq Bv\leq 5\%$, but may be variously set in accordance with a user's settings, genres of an image to be displayed, or environments.

The frame motion variance detector 230 may be for example materialized by software based on an algorithm for recognizing and tracking an object in a frame and/or embedded hardware in which motion variance detection algorithm is designed as hardware. The frame motion variance detector 230 detects whether there is motion variance in a frame to be currently displayed on the display panel 100 among the frames stored in the storage 210 or the frames of the input image data. The motion variance of the frame is defined by a motion vector represented with a moving distance and moving direction of an object between an adjacent frame and a frame. The motion vector is represented by a product of the velocity v of the object and an image cycle T. The object in the frame may be for example recognized by an object characteristic-based method of recognizing and tracking local image characteristics such as boundary value (edge) information, contrast information, color information, motion information, etc. Of course, the object may be recognized by various methods such as a linear subspace method in addition to the object characteristic-based method. The detection of the frame motion variance is performed by measuring the distance and direction of the object moved from the previous frame n−1 to the current frame n. The moving distance of the object is related to the moving velocity. In case of car racing and the like very fast action, the motion variance is very large between the frame and the frame. In case of human walking and the like action, the motion variance is small between the frame and the frame. Therefore, a moving distance of a specific object between adjacent frames, e.g. a first frame to be currently displayed and a second frame previously displayed may be used as a criterion of determining the motion variance. In particular, when an object displayed in the previous second frame disappears in the current first frame, or when an object not displayed in the previous second frame appears in the current first frame, the object may have so large motion variance that it moves faster than 16.7 ms, i.e. time taken in displaying one frame for an image of 60 Hz, or may have no continuity from the previous frame since it belongs to a new scene. Like this, when it is impossible to detect a relative moving distance of an object between two adjacent frames, it is determined that the motion variance is the largest. However, an exception has to be made for a case where the existing object disappears or a new object appears within a short distance from the edges of the frame. In other words, the motion variance in this case is substantially equivalent to a very short distance from the edge to the object regardless of the moving velocity of the object. The detection of the frame motion variance may be performed by calculating a moving distance of an object from a plurality of previous frames, e.g. five frames n−1 to n−5 to the current frame n. Of course, when a plurality of objects are displayed on the current frame, the frame motion variance may be detected by measuring an average moving distance of the objects. The detection of the frame brightness change may be performed by comparison between an average moving distance of a plurality of frames to be displayed, e.g. five frames n to n+4 with an average moving distance of a plurality of previous frames, e.g. five frames n−1 to n−5. Of course, the plurality of frames is not limited to five frames, but may be set properly.

The detection of the frame motion variance may be performed by dividing one frame into a plurality of pixel block areas, e.g. sixteen pixel blocks and calculating a moving distance of an object included in each area. In this case, the moving distances of the object in the areas are averaged to obtain an average moving distance of the frame. Likewise, when a degree of motion variance is very low, there are no advantages in determining that the motion is varied. Therefore, it is determined that the motion is not varied when an object motion vector of the current frame is within a predetermined threshold value, and it is determined that the motion is varied only when the object motion vector of the current frame is beyond the threshold value.

The timing controller 240 includes a frame rate controller (FRC) for controlling a frame rate applied to the display panel 100, and receives a horizontal sync signal H_sync, a vertical sync signal V_sync for determining a frame frequency of the display panel 100, image data DATA, a main clock CLK, and a reference clock CLK. The timing controller 240 converts the image data DATA in accordance with formats required in the data driver 130 and supplies pixel data RGB_DATA to the data driver 130. The timing controller 240 provides the gate control signal GCS for controlling the gate driver 120 and the data control signal DCS for controlling the data driver 130 to the gate driver 120 and the data driver 130, respectively. Further, the timing controller 240 modulates the horizontal sync signal H_sync and the vertical sync signal V_sync based on the reference clock, and provides a dimming signal BDS and a light source driving signal BOS to the light source driver 150 based on the horizontal sync signal H_sync and the vertical sync signal V_sync.

The timing controller 240 controls the light source driver 150 to apply the PWM signals of 120 Hz or 240 Hz to the light source 160, i.e. two or four impulses to the current frame when the frame brightness change detector 220 determines that the frame to be currently displayed has no brightness change. When the frame brightness change detector 220 determines that the frame to be currently displayed has a brightness change, the light source driver 150 applies the PWM signal of 60 Hz to the light source 160, i.e. one impulse to the frame to be currently displayed.

When it is determined that the frame to be currently displayed has no brightness change, the timing controller 240 determines the frequency of the PWM signal to be applied from the light source driver 150 to the light source 160 in accordance with the motion variance additionally determined in the frame motion variance detector 230. That is, when there are no brightness changes and there are no motion variances, the PWM signals of 120 Hz or 240 Hz, i.e. two or four impulses are applied to the current frame. When there are no brightness changes but there is the motion variance, the PWM signal of 60 Hz, i.e. one impulse is applied to the current frame. In result, when neither the brightness change nor the motion variance is given, the PWM signal of 60 Hz may cause a flicker and therefore the PWM signal of 120 Hz or 240 Hz is used to reduce the flicker. When there is the brightness change or when there is the motion variance without the brightness change, the PWM signal of 60 Hz is used to reduce a blur.

Figure 3:
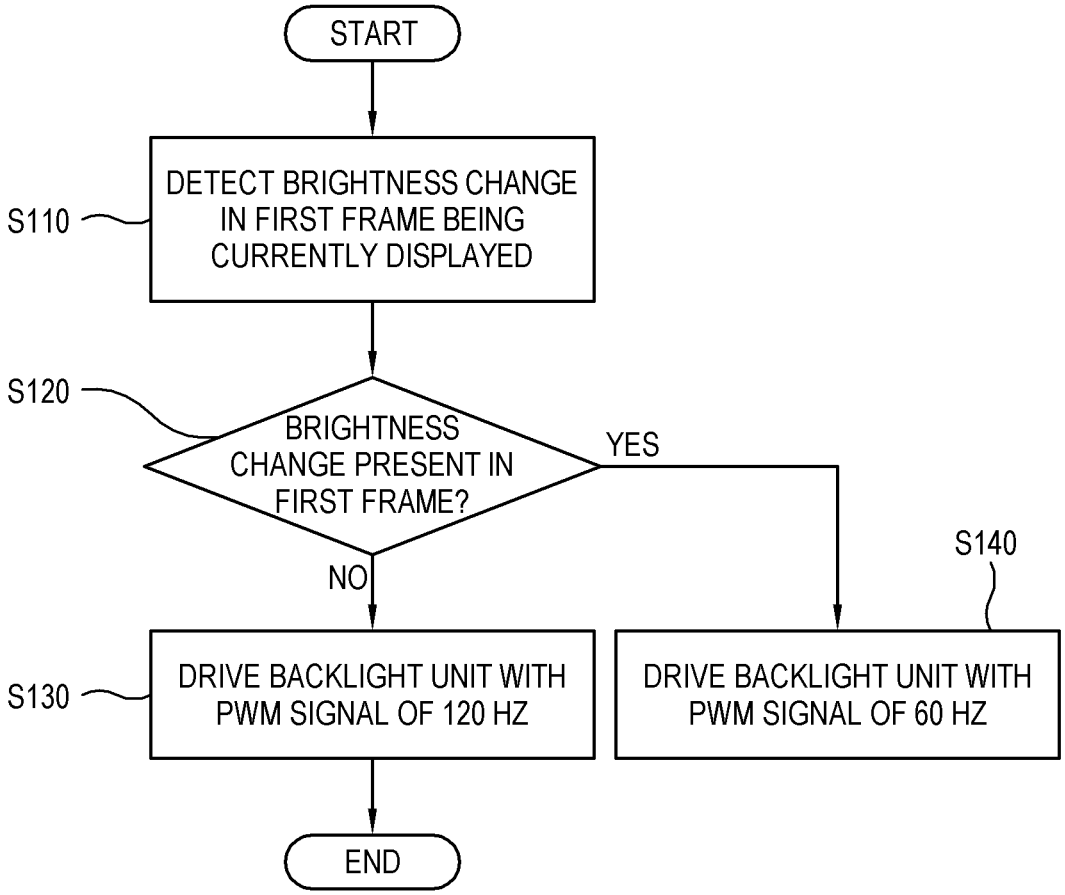
FIG. 3 is a flowchart of an image display method according to one embodiment of the present invention.

FIG. 3 is a flowchart of an image display method of the display device 1 according to one embodiment of the present invention.

At operation S110, the brightness change detector 220 detects a brightness change with regard to a current frame n stored in a frame memory, i.e. a storage 210 to perform display. The frame brightness change refers to a difference in average pixel level between the previous second frame and the current first frame. The average pixel level APL1 is a value obtained by dividing the sum of brightness levels corresponding to all the pixels of one frame by the number of pixels.

In case of the average pixel level APL1 of the first frame, as shown in FIG. 4, the first frame is divided into a plurality of pixel blocks b1~b16, and average pixel levels of the respective blocks are calculated and then divided by 16 to thereby obtain the average pixel level of the first frame. Herein, the average pixel level of the block is an average of brightness levels corresponding to all the pixels in the block. When each pixel has 256 gray scales (0~255), the average pixel level APL1 of the first frame and the average pixel level APL2 of the second frame n−1 are calculated as follows.

2179/16=136 APL1:

2164/16=135 APL2:

Therefore, there is a difference of 1 in brightness between the currently displayed first framed and the previously displayed second frame. In other words, the brightness of the first frame is changed as much as a grayscale of 1. The brightness change rate Bv (%) is obtained by (|APL1−APL2|)/APL2 and has a value of about 0.7%.

In FIG. 4, four blocks b2, b3, b6 and b7 among sixteen pixel blocks are changed in brightness level. In this case, the average pixel level APL1 of the first frame and the average pixel level APL2 of the second frame are expressed as follows.

(116+125+115+101)/4=114 APL1:

(115+120+111+096)/4=110 APL2:

Thus, the currently displayed first frame has a local brightness change as much as 4 grayscales. The brightness change rate Bv is of about 4%. Like this, only the blocks, in which the brightness change is present, among the plurality of pixel blocks are compared in brightness level, thereby clearly obtaining the brightness change.

Figure 5:
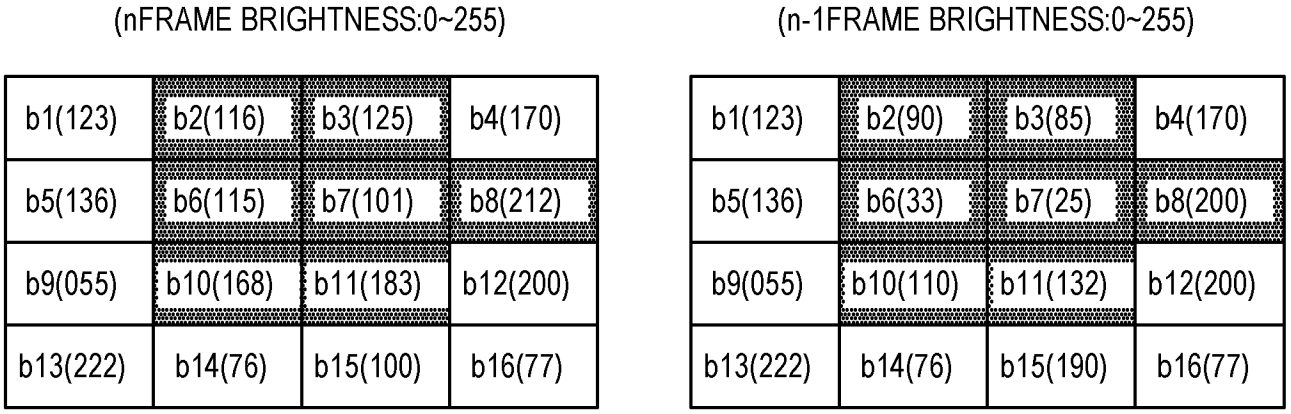

FIG. 5 shows another example of the brightness level of the frame. In FIG. 5, the average pixel level APL1 of the first frame and the average pixel level APL2 of the second frame n−1 are calculated as follows.

2079/16=130 APL1:

1924/16=120 APL2:

Thus, there is a difference of 10 in brightness between the currently displayed first frame and the previously displayed second frame. In other words, the brightness of the first frame is changed as much as grayscales of 10. The brightness change rate Bv (%) is obtained by (|APL1−APL2|)/APL2 and has a value of about 8%.

In FIG. 5, seven blocks b2, b3, b6, b7, b8, b10, b11 among sixteen pixel blocks are changed in brightness level. In this case, the average pixel level APL1 of the first frame and the average pixel level APL2 of the second frame are expressed as follows.

(116+125+115+101+212+168+183)/7=146 APL1:

(115+120+111+096+200+110+132)/7=126 APL2:

Thus, the currently displayed first frame has a local brightness change as much as 20 grayscales. The brightness change rate Bv is of about 15%.

Figure 6:
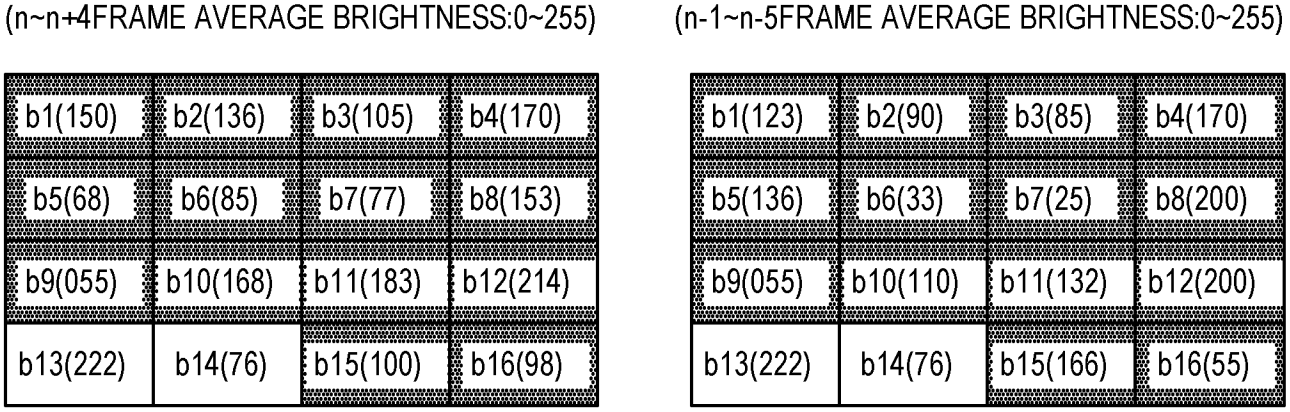

FIG. 6 shows still another example of the brightness level of the frame. In FIG. 6, the average pixel level APL1 of the first frame and the average pixel level APL2 of the second frame n−1 are calculated as follows.

2060/16=128 APL1:

1666/16=104 APL2:

Thus, there is a difference of 24 in brightness between the currently displayed first frame and the previously displayed second frame. In other words, the brightness of the first frame is changed as much as grayscales of 24. The brightness change rate Bv (%) is obtained by (|APL1−APL2|)/APL2 and has a value of about 23%.

In FIG. 6, fourteen blocks b1~b12, b15 and b16 among sixteen pixel blocks are changed in brightness level. In this case, the average pixel level APL1 of the first frame and the average pixel level APL2 of the second frame are expressed as follows.

1762/14=126 APL1:

1368/14=98 APL2:

Thus, the currently displayed first frame has a local brightness change as much as 28 grayscales. The brightness change rate Bv is of about 28%.

As described above, the frame brightness change detector 220 can calculate the average pixel level of the adjacent frames. At operation S120, the frame brightness change detector 220 determines whether the brightness of the frame is changed based on an average of brightness levels of all the pixels within one frame or an average of brightness levels of changed blocks among the plurality of pixel blocks. Since a very small change among the frame brightness changes does not have an effect on visibility of a flicker, a boundary value for the brightness change may be set to determine whether the brightness of the frame is changed or not. That is, when the brightness change rate Bv is equal to or lower than 10%, it may be determined that there are no brightness changes. When the brightness change rate Bv is higher than 10%, it may be determined that the brightness change is present. Instead of comparison between the current frame and the previous frame, comparison between the current frame and the following frame may be used to detect the brightness change.

When it is determined in the operation S120 that the first frame has no brightness changes, at operation S130 the timing controller 240 provides a control signal so that the light source driver 150 can apply a PWM signal of 120 Hz or 240 Hz to the light source 160.

On the other hand, when it is determined in the operation S120 that the first frame has a brightness change, at operation S140 the timing controller 240 provides a control signal so that the light source driver 150 can apply a PWM signal of 60 Hz to the light source 160.

Figure 7:
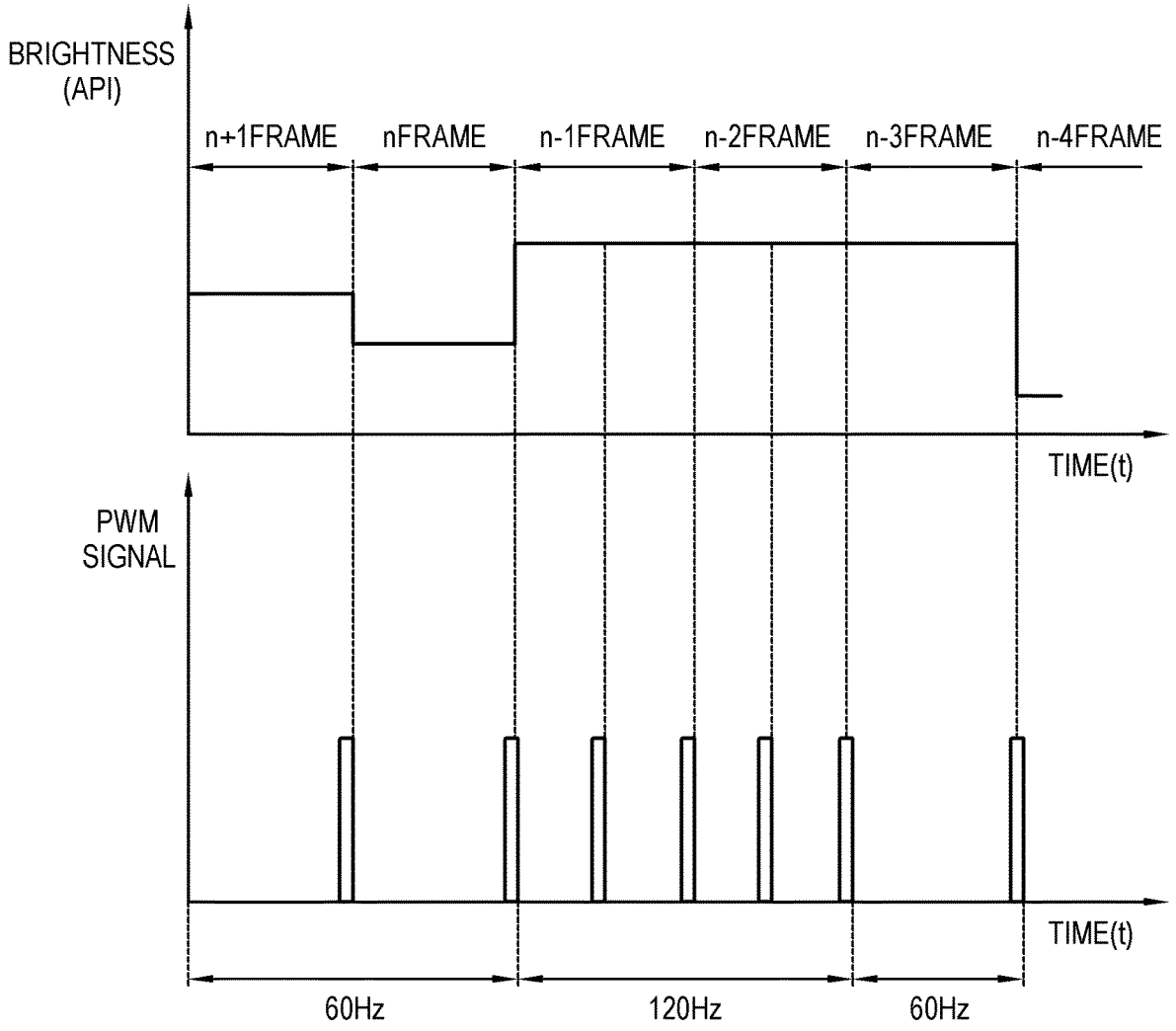
FIG. 7 is a view of showing brightness according to frames and a PWM signal corresponding thereto.

FIG. 7 shows a PWM signal, a frequency of which is varied depending on brightness changes in each frame of input image data. Referring to FIG. 7, there is a considerable difference in the average pixel level between the (n−3)th frame and the (n−4)th frame, and it is thus determined that the brightness change is present, thereby providing a PWM pulse of 60 Hz (one pulse per frame). Since the average pixel levels of the (n−2)th and (n−1)th frames are similar to the average pixel level of the (n−3)th frame, it is determined that there are no brightness changes, thereby providing a PWM pulse of 120 Hz (two pulses per frame). Since the average pixel level of the nth frame is lower than the average pixel level of the (n−1)th frame, it is determined that the brightness change is present, thereby applying a PWM pulse of 60 Hz (one pulse per frame). Since there is a considerable difference in the average pixel level between the (n+1)th frame and the nth frame, it is determined that the brightness change is present, thereby applying a PWM pulse of 60 Hz (one pulse per frame).

Figure 8:
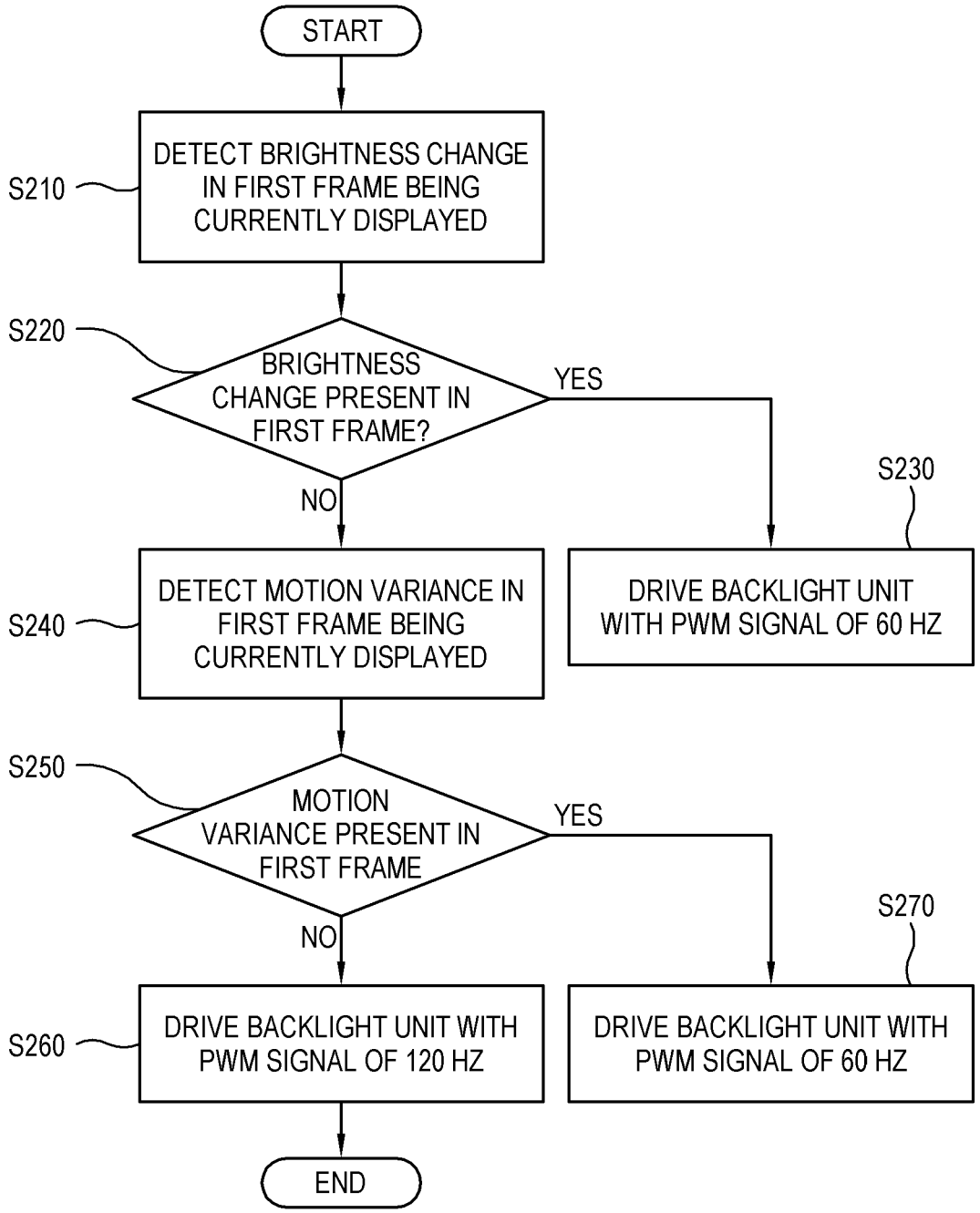
FIG. 8 is a flowchart of an image display method according to another embodiment of the present invention.

FIG. 8 is a flowchart of an image display method of the display device 1 according to another embodiment of the present invention.

At operation S210, the brightness change detector 220 detects a brightness change with regard to a current frame n stored in a frame memory, i.e. the storage 210 to perform display. The frame brightness change refers to a difference in average pixel level between the previous second frame and the current first frame. The average pixel level APL1 is a value obtained by dividing the sum of brightness levels corresponding to all the pixels of one frame by the number of pixels.

The brightness change of the first frame to be currently displayed on the display panel 100 may be determined by comparison between the first average pixel level APL1 of the first frame and the second average pixel level APL2 obtained by averaging the average pixel levels of the pixel blocks as described above in the examples of FIGS. 4 to 6 with regard to the previously displayed second frame.

Thus, the frame brightness change detector 220 can calculate the average pixel levels of the adjacent frames. At operation S220, the frame brightness change detector 220 determines whether the brightness of the frame is changed or not based on an average of brightness levels of all pixels within one frame or an average of brightness levels of changed blocks among a plurality of pixel blocks. Since a very small change among the frame brightness changes does not have an effect on visibility of a flicker, a boundary value for the brightness change may be set to determine whether the brightness of the frame is changed or not. That is, when the brightness change rate Bv is equal to or lower than 10%, it may be determined that there are no brightness changes. When the brightness change rate Bv is higher than 10%, it may be determined that the brightness change is present.

When it is determined in the operation S220 that the first frame has a brightness change, at operation S230 the timing controller 240 provides a control signal so that the light source driver 150 can apply a PWM signal of 60 Hz to the light source 160.

On the other hand, when it is determined in the operation S220 that the first frame has no brightness changes, at operation S240 the frame motion variance detector 230 detects motion variance of the first frame. There may be various methods of detecting the motion variance. According to an embodiment of the present invention, for example, the motion variance is detected by extracting a feature point of an object through scale invariant feature transform (SIFT), recognizing the object based on the comparison, and tracking the recognized object. The SIFT refers to a technique to detect or recognize an object of interest within an image based on invariant features (e.g. scale, expression, and affine distortion) and a partially invariant feature (e.g. a brightness value). That is, the SIFT refers to an algorithm that simply extracts information, which can represent a certain object the best, from the object. As a method, a scale space where an image is adjusted in many sizes is first made, and then a largely obtained image and a small obtained image are all taken into account, thereby extracting the invariant feature point regardless of scale changes. To obtain a small scaled image, a Gaussian kernel is used. As variance of the Gaussian Kernel to perform convolution with an image becomes larger, there is an effect on making a smaller image. When the variance becomes larger to some extent, an original image is decreased in size and the convolution with the Gaussian kernel is performed. Next, a difference of Gaussian (DoG) between neighboring images is calculated. In the scale space, local extrema of the DoG are selected as the feature points. Such selected points have invariant features regardless of scale changes. To give features of rotational invariance to the position-determined feature points, a gradient direction at the feature point is calculated. A descriptor of the SIFT is an orientation histogram in an area around the feature point.

Figure 9:
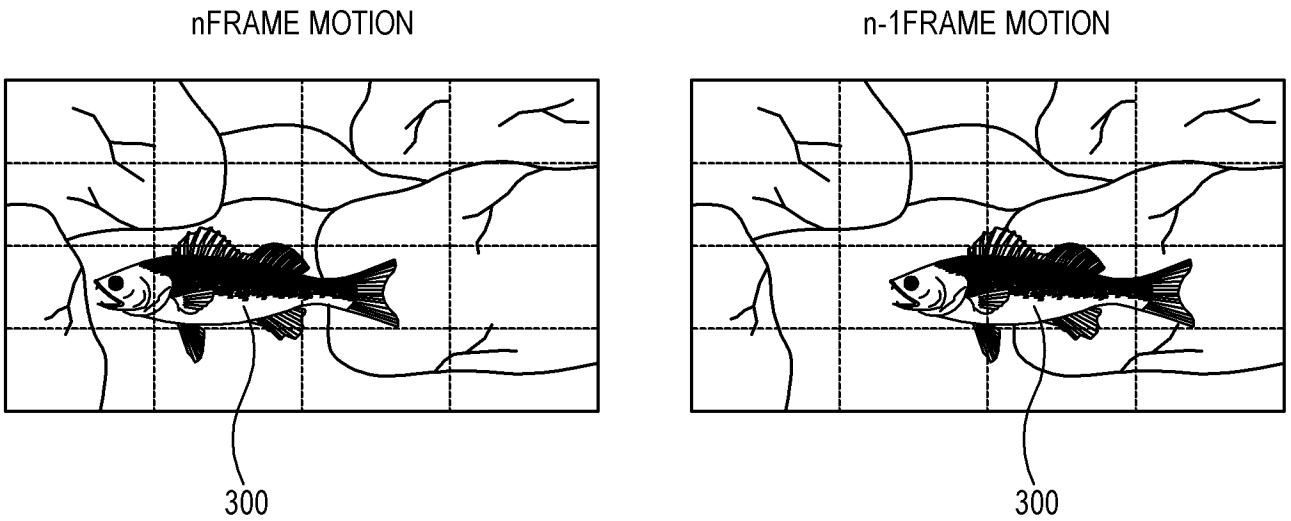
FIGS. 9 to 11 are views of illustrating variance in motion of objects according to frames.

FIG. 9 shows two frames n and n−1 in which a fish moves in water. The frame motion variance detector 230 recognizes a fish object 300 based on the feature points, calculates a moving distance and direction (i.e. a motion vector) of the fish object 300 between adjacent frames (e.g. (n−1)th and nth frames), and determines whether there is a motion variance based on comparison in the motion vector between the current first frame (e.g. nth frame) and the previous second frame (e.g. (n−1)th frame). Like this, when it is determined that the motion variance is present in the current first frame, a PWM pulse of 60 Hz (one impulse) is applied when the first frame is displayed. With regard to all frames of an input image signal, a brightness change and a motion variance are detected and a PWM signal is applied variably depending on conditions. Referring to FIG. 9, the motion vector of the fish object 300 is measurable by only position movement of the object itself since its magnitude has no changes, and thus defined by length and direction of a line connecting the center point of the fish object 300 in the second frame and the center point of the fish object 300 in the first frame. In result, the extent of the motion variance is detected based on the moving distance of the fish object 300.

Figure 10:
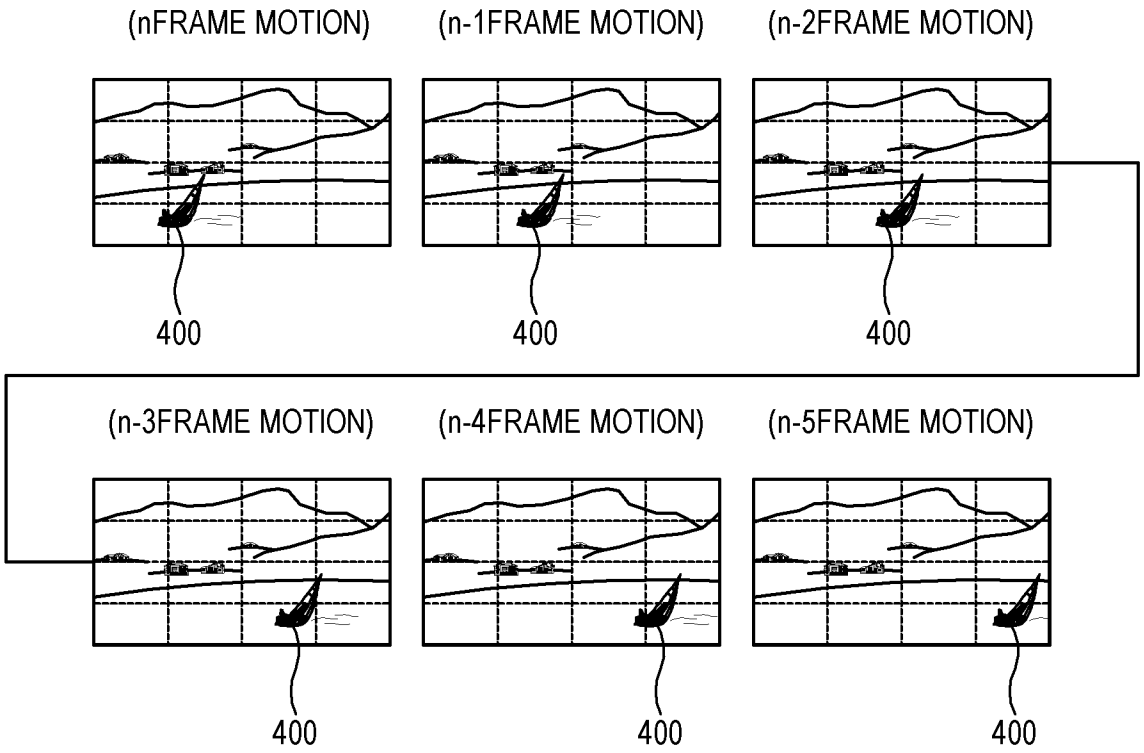
Figure 11:
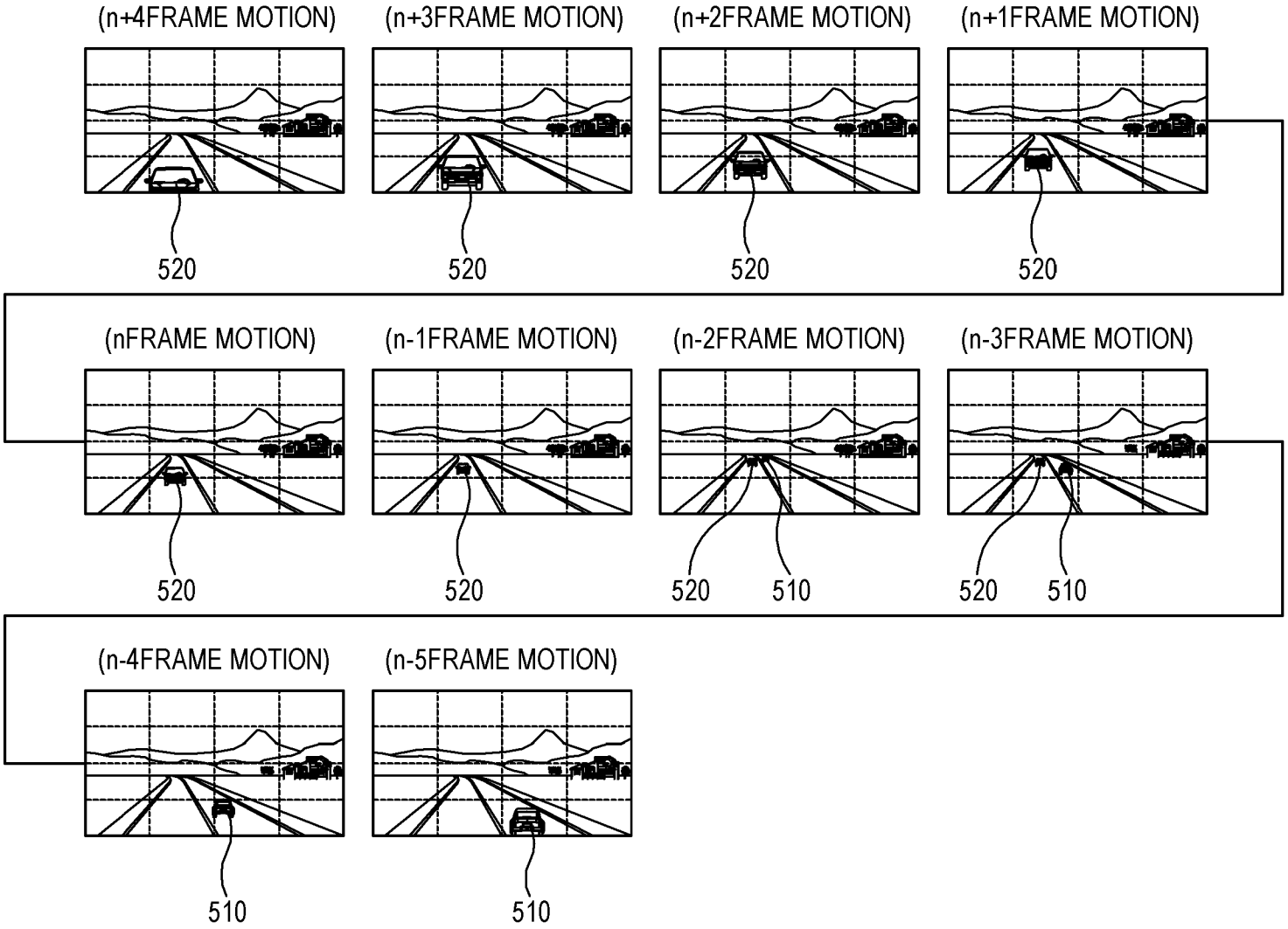

FIG. 10 shows six frames n−5 to n in which a yacht moves in the sea. The frame motion variance detector 230 recognizes a yacht object 400 based on the feature points, calculates a moving distance and direction (i.e. a motion vector) of the yacht object 400 between adjacent six frames (e.g. (n−5)th to nth frames), and determines whether there is a motion variance based on comparison in the motion vector between the current first frame (e.g. nth frame) and a group of five previous frames (e.g. (n−1)th to (n−5)th frames). Referring to FIG. 10, the motion vector of the yacht object 400 is measurable by only position movement of the object itself since its magnitude has no changes, and thus defined by length and direction of a line connecting the center point of the yacht object 400 in the (n−5)th second frame (the center point of a virtual circle or quadrangle passing through the outermost line of the object) and the center point of the fish object 300 in the nth frame. In result, the extent of the motion variance may be detected based on the moving distance of the yacht object 400 from the (n−5)th frame to the nth frame FIG. 11 shows ten frames n−5 to n+4 in which a car moves on a road. The frame motion variance detector 230 recognizes the car objects 510 and 520 based on the feature points, calculates a moving distance and direction (i.e. a motion vector) of the car objects 510 and 520 between adjacent ten frames (e.g. (n−5)th to (n+4)th frames), and determines whether there is a motion variance based on comparison in the motion vector between a first group of five frames (e.g. nth to (n+4)th frames) and a second group of five previous frames (e.g. (n−1) to (n−5)th frames). Referring to FIG. 11, the first car object 510 moves away with respect to the road in the (n−4)th frame and disappears in the (n−1)th frame, and the second car object 520 appears in the (n−3)th frame and gradually moves closer. In the first group, the first car object 510 little contributes to the motion variance since it disappears. On the other hand, the second car object 520 much contributes to the motion variance since its motion variance is in between the first group and the second group. Therefore, it is determined whether there is a motion variance, by calculating the motion variance of the first car object 510 and the motion variance of the second car object 520 in the first group and the second group.

In FIG. 11, the motion vector of the first car object 510 may be measured by considering both the motion vector caused by the size change (i.e. the area change) and the motion vector caused by the position movement since the size and position of the object 521 are respectively changed and moved. Alternatively, the motion variance of the first car object 510 may be detected based on an average length of a plurality of connection lines connecting an outer line of the first car object 510 in the (n−5)th frame and a corresponding outer line of the first car object 510 in the (n−2)th frame. Similarly, the motion vector of the second car object 520 may be measured by considering both the motion vector caused by the size change (i.e. the area change) and the motion vector caused by the position movement since the size and position of the object 520 are respectively changed and moved. Alternatively, the motion variance of the second car object 520 may be detected based on an average length of a plurality of connection lines connecting an outer line of the second car object 520 in the (n−3)th frame and a corresponding outer line of the second car object 520 in the (n+4)th frame.

Figure 12:
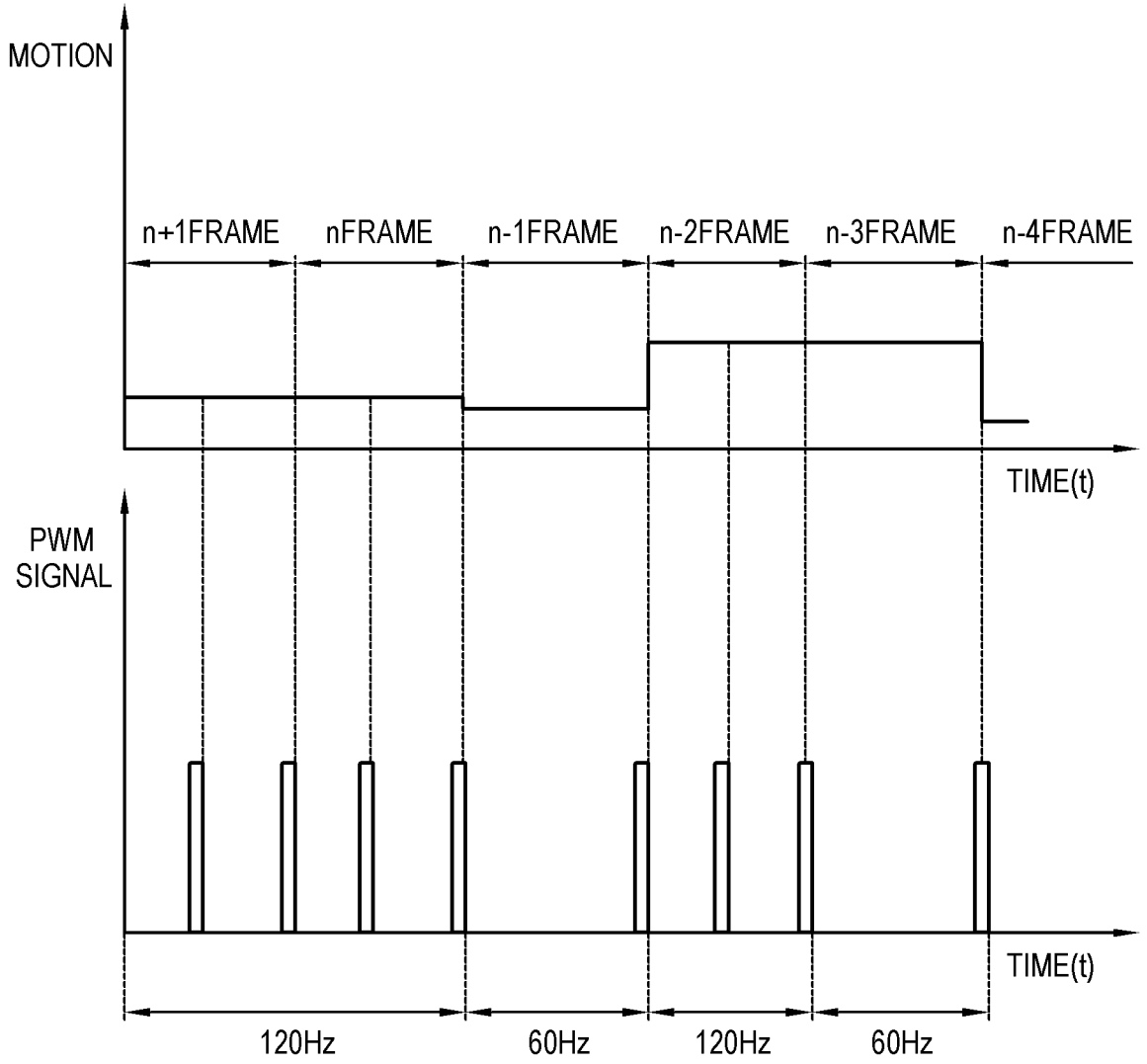
FIG. 12 is a view of showing motion according to frames and a PWM signal corresponding thereto.

FIG. 12 shows that the PWM signal applied to the light source 160 is varied in frequency depending on whether there is a motion variance of each frame. In FIG. 12, the motion variance of the (n−3)th frame exceeds a predetermined threshold value as compared with the (n−4)th frame, and it is thus determined that a motion variance is present, thereby applying a PWM pulse of 60 Hz (i.e. one pulse per frame). The motion variance of the (n−2)th frame is within the predetermined threshold value as compared with the (n−3)th frame, and it is thus determined that the motion variance is not present, thereby applying a PWM pulse of 120 Hz (i.e. two pulses per frame). The motion variance of the (n−1)th frame exceeds the predetermined threshold value (a movement amount range of an object) as compared with the (n−2)th frame the motion variance, and it is thud determined that the motion variance is present, thereby applying the PWM pulse of 60 Hz (one pulse per frame). The motion variance of nth frame is within the predetermined threshold value as compared with the (n−1)th frame, and it is thus determined that the motion variance is not present, thereby applying the pulse of 120 Hz (i.e. two pulses per frame). The motion variance of (n+1)th frame is within the predetermined threshold value as compared with the nth frame, and it is thus determined that the motion variance is not present, thereby applying the PWM pulse of 120 Hz (two pulses per frame). Here, the threshold value for the motion variance may be set based on a motion vector having a predetermined magnitude, e.g. an object's own movement amount (length change) and an object's own size change (area change).

Figure 13:
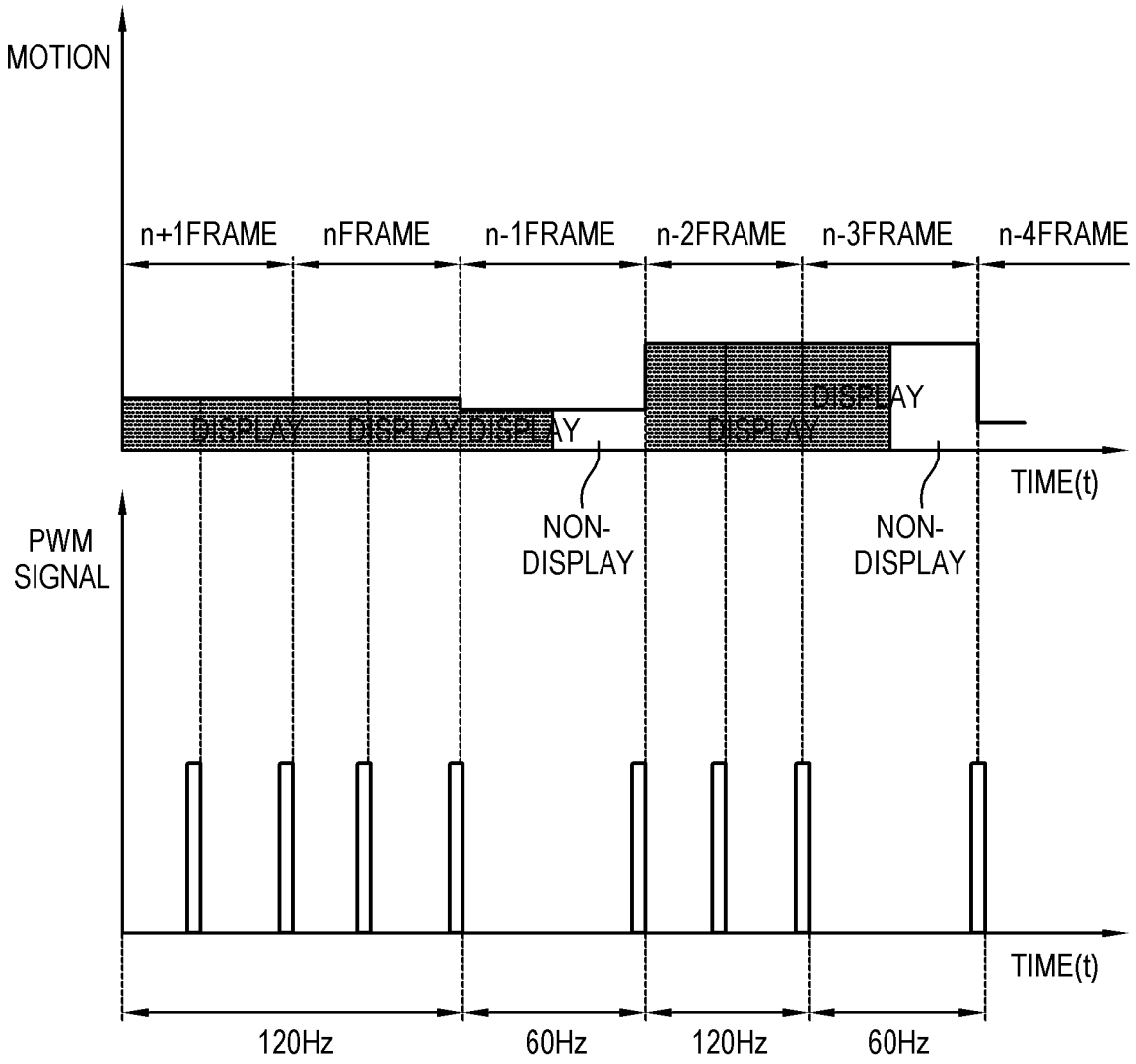
FIG. 13 is a view of a data display method corresponding to motion variance according to frames.

FIG. 13 is a view of a data display method according to motion variances of frames. In FIG. 13, the motion variance of the (n−3)th frame exceeds a predetermined threshold value as compared with the (n−4)th frame, and it is thus determined that the motion variance is present, thereby applying a PWM pulse of 60 Hz (i.e. one pulse per frame), and embedding a non-display area in the (n−4)th frame to decrease a blur. The motion variance of the n−2th frame is within the predetermined threshold value as compared with the (n−3)th frame and it is thus determined that the motion variance is not present, thereby applying a PWM pulse of 120 Hz (i.e. two pulses per frame), and performing a display throughout the frame. The motion variance of the (n−1)th frame exceeds a predetermined threshold value as compared with the (n−2)th frame, and it is thus determined that the motion variance is present, thereby applying the PWM pulse of 60 Hz (i.e. one pulse per frame), and embedding a non-display area in the (n−4)th frame to decrease a blur. The motion variance of nth frame is within the predetermined threshold value as compared with the (n−1)th frame, and it is thus determined that the motion variance is not present, thereby applying the PWM pulse of 120 Hz (i.e. two pulses per frame), and performing a display throughout the frame. The motion variance of the (n+1)th frame is within the predetermined threshold value as compared with the nth frame, and it is thus determined that the motion variance is not present, thereby applying the PWM pulse of 120 Hz (i.e. two pulses per frame) and performing a display throughout the frame.

As described above, the timing controller 240 including the frame rate controller (FRC) detects the brightness change and motion variance of the frame or frame group, and controls the light source driver 150 so that the PW signal having a variable frequency can be applied to the light source 160, thereby including a non-display area to not only decrease a flicker but also decrease a motion blur when the motion variance is detected.

Although a few exemplary embodiments and drawings have been shown and described, it will be appreciated by those skilled in the art that various modifications and changes may be made in these exemplary embodiments without departing from the principles and spirit of the invention.

The operations according to the foregoing exemplary embodiments may be performed by a single controller. In this case, a program command for performing the operations to be implemented by various computers may be recorded in a computer readable medium. The computer determinable medium may contain a program command, a data file, a data structure, etc. or combination thereof. The program command may be specially designed and made for the foregoing embodiments, or publicly known and available to those skilled in the art. As an example of the computer readable medium, there are a magnetic medium such as a hard disk drive, a floppy disk, a magnetic tape, etc. an optical medium such as a compact disc read only memory (CD-ROM), a digital versatile disc (DVD), a magnetic-optical medium such as a floptical disk, and a hardware device such as a read only memory (ROM), a random access memory (RAM), a flash memory, etc. specially configured to store and execute a program command. As an example of the program command, there is not only a machine code made by a compiler but also a high-level language code to be executable by a computer through an interpreter or the like. If a base station or relay described in this exemplary embodiment is fully or partially achieved by a computer program, the computer readable medium storing the computer program also belong to the present invention.

Therefore, the foregoing has to be considered as illustrative only. The scope of the invention is defined in the appended claims and their equivalents. Accordingly, all suitable modification and equivalents may fall within the scope of the invention.

The invention claimed is:

1. A display device comprising:

a display panel configured to display an image of a series of frames based on input image data;

a light source configured to emit light to the display panel;

a light source driver configured to supply a driving signal to the light source so that the light source can emit light; and a processor configured to detect a brightness change of a first frame of image data input to the display panel, control the light source driver to supply a driving signal having a first frequency to the light source when the brightness change is lower than a predetermined boundary value, and control the light source driver to supply a driving signal having a second frequency lower than the first frequency to the light source when the brightness change is higher than the predetermined boundary value, wherein the processor is further configured to detect the brightness change of the first frame based on a difference between a brightness of the first frame and a brightness of a second frame which is a previous frame of the first frame.

2. The display device according to claim 1, wherein each of the first frame and the second frame includes a plurality of pixel block areas, and the brightness change is detected based on comparison between each brightness of the plurality of pixel block areas in the second frame and each corresponding brightness of the plurality of pixel block areas in the first frame.

3. The display device according to claim 1, wherein the brightness change is detected by:

calculating the difference between the brightness of the first frame and the brightness of the second frame, determining that the brightness change is not present when the calculated difference is within the predetermined boundary value, and determining that the brightness change is present when the calculated difference exceeds the predetermined boundary value.

4. The display device according to claim 3, wherein the predetermined boundary value is divided into a first boundary value and a second boundary value higher than the first boundary value, and the processor controls the light source driver to supply a driving signal having a third frequency higher than the first frequency when the brightness change of the first frame is lower than the first boundary value, and controls the light source driver to supply the driving signal having the first frequency when the brightness change is higher than the first boundary value and lower than the second boundary value.

5. The display device according to claim 4, wherein the first boundary value is equal to or lower than 5%, and the second boundary value is higher than 5% and lower than 10%.

6. The display device according to claim 1, wherein the first frequency is 120 Hz, and the second frequency is 60 Hz.

7. The display device according to claim 1, wherein the processor detects a motion variance in the first frame, controls the light source driver to supply the driving signal having the first frequency when the motion variance is not present, and controls the light source driver to supply the driving signal having the second frequency when the motion variance is present.

8. The display device according to claim 7, wherein the first frame is displayed as divided into an image display section and a non-display section when the motion variance is present.

9. The display device according to claim 7, wherein the motion variance is detected by obtaining a motion vector from change in between an object in the first frame and an object in a previously displayed second frame.

10. The display device according to claim 9, wherein each of the first frame and the second frame includes a plurality of pixel block areas, and the motion vector is obtained from change in between an object in each of the plurality of pixel block areas of the second frame and a corresponding object in each of the plurality of pixel block areas of the first frame.

11. The display device according to claim 9, wherein it is determined that the motion variance is not present when the motion vector is within a predetermined threshold value, and it is determined that the motion variance is present when the motion vector is beyond the predetermined threshold value.

12. The display device according to claim 11, wherein the predetermined threshold value is divided into a first threshold value and a second threshold value higher than the first threshold value, and the processor controls the light source to supply a driving signal having a third frequency higher than the first frequency when the motion variance of the first frame is within the first threshold value, and controls the light source driver to supply the driving signal having the first frequency when the motion variance is within the second threshold value.

13. The display device according to claim 9, wherein the motion variance is detected by obtaining a motion vector from change in between an object in the first frame and an object in a plurality of second frames.

14. An image display method of a display device comprising a display panel, a light source configured to emit light to the display panel, and a light source driver configured to supply a driving signal to the light source, the method comprising:

detecting a brightness change of a first frame of image data input to the display panel; and controlling the light source driver to supply a driving signal having a first frequency to the light source when the brightness change is lower than a predetermined boundary value, and controlling the light source driver to supply a driving signal having a second frequency lower than the first frequency to the light source when the brightness change is higher than the predetermined boundary value, wherein the detecting the brightness change of the first frame comprises detecting the brightness change of the first frame based on a difference between a brightness of the first frame and brightness of a second frame which is a previous frame of the first frame.

15. The image display method according to claim 14, wherein the brightness change is detected by calculating the difference between the brightness of the first frame and the brightness of the second frame, determining that the brightness change is not present when the calculated difference is within the predetermined boundary value, and determining that the brightness change is present when the calculated difference exceeds the predetermined boundary value, wherein the predetermined boundary value is divided into a first boundary value and a second boundary value higher than the first boundary value, and wherein the light source driver is controlled to supply a driving signal having a third frequency higher than the first frequency when the brightness change of the first frame is lower than the first boundary value, and the light source driver is controlled to supply the driving signal having the first frequency when the brightness change is higher than the first boundary value and lower than the second boundary value.

16. The image display method according to claim 15, wherein the first boundary value is equal to or lower than 5%, and the second boundary value is higher than 5% and lower than 10%.

17. The image display method according to claim 14, wherein the method further comprises detecting a motion variance in the first frame, controlling the light source driver to supply the driving signal having the first frequency when the motion variance is not present, and controlling the light source driver to supply the driving signal having the second frequency when the motion variance is present, wherein the motion variance is detected by obtaining a motion vector from change in between an object in the first frame and an object in a previously displayed second frame, wherein it is determined that the motion variance is not present when the motion vector is within a predetermined threshold value, and it is determined that the motion variance is present when the motion vector is beyond the predetermined threshold value, wherein the predetermined threshold value is divided into a first threshold value and a second threshold value higher than the first threshold value, and wherein the light source is controlled to supply a driving signal having a third frequency higher than the first frequency when the motion variance of the first frame is within the first threshold value, and the light source driver is controlled to supply the driving signal having the first frequency when the motion variance is within the second threshold value.

* * * * *